US007293896B2

(12) United States Patent
Cheung

(10) Patent No.: US 7,293,896 B2
(45) Date of Patent: Nov. 13, 2007

(54) LED DECORATIVE LIGHT STRING

(75) Inventor: Tung Fong Cheung, Hong Kong (CN)

(73) Assignee: Optosupply Electronics (Shenzhen) Limited, Longdong Village, Longgang District, Shenzhen (CN)

( * ) Notice: Subject to any disclaimer, the term of this patent is extended or adjusted under 35 U.S.C. 154(b) by 42 days.

(21) Appl. No.: 11/306,877

(22) Filed: Jan. 13, 2006

(65) Prior Publication Data

US 2006/0198143 A1 Sep. 7, 2006

(30) Foreign Application Priority Data

Jan. 14, 2005 (CN) ..... 2005 1 0032839

(51) Int. Cl.
*F21V 13/14* (2006.01)

(52) U.S. Cl. ..... 362/252

(58) Field of Classification Search ..... 362/252, 362/806, 231; 315/185 R–185 S
See application file for complete search history.

(56) References Cited

U.S. PATENT DOCUMENTS 3,869,641 A * 3/1975 Goldberg ..... 315/135
5,936,599 A * 8/1999 Reymond ..... 345/82
6,688,754 B1 * 2/2004 Wu ..... 362/249
2004/0201988 A1 * 10/2004 Allen ..... 362/249
2004/0207341 A1 * 10/2004 Callahan ..... 315/291

* cited by examiner

*Primary Examiner*—Thomas M. Sember
*Assistant Examiner*—Julie A. Shallenberger
(74) *Attorney, Agent, or Firm*—Global IP Services; Tianhua Gu

(57) ABSTRACT

The present invention provides a LED decorative light string that comprises one or more branch circuits, each of said more branch circuits is connected in parallel with each other, and then connected to a common power supply wire for importing operational voltage; each said branch circuit comprises a quantity of light groups, and said quantity of light groups are serially connected in turn; each said light group comprises two or more LEDs, wherein at least one LED is connected in parallel with other LEDs in reverse direction, said other LEDs are connected in parallel in the same direction. The LED decorative light string of the present invention has the advantage of more economical, more reliable in performance, longer life span.

9 Claims, 3 Drawing Sheets

LED DECORATIVE LIGHT STRING

CROSS REFERENCE TO RELATED APPLICATION

This application claims the benefit of a Chinese patent application No. 200510032839.4 (CN), filed on Jan. 14, 2005.

FIELD OF INVENTION

The present invention relates to decorative light, and more particularly, to a bunchily connected LED decorative light string.

BACKGROUND OF THE INVENTION

In celebration days of Spring Festival, Christmas day and so on, people hang generally various decorative light strings to decorate a room, an aisle, Christmas trees and so on, in which the more often used is a bunchy LED decorative light string.

A LED decorative light string in the prior art is shown in FIG. 1, wherein each of the LEDs is simply connected in parallel between each other, and is connected to an operational power supply. As a result of parallel connection between each LED, the failure of any one of LEDs will not affect the operation of the other LEDs. However, since the operating voltage of the LEDs is lower, the LED decorative light string in such connecting relation may not be directly connected to AC power supply, and then a corresponding step-down transformer is required, such that the cost of the whole production would be increased.

Another LED decorative light string in the prior art is shown in FIG. 2, wherein each of LEDs is generally simple connected in series, then the LED decorative light string is connected to an operational power supply (generally is AC power supply). One disadvantage of such decorative light string is that the whole decorative light string will be led to disconnection and can not be in operation when a certain LED is in failure, thereby its reliability is rather poor and its life-span is shorter.

For the decorative light string shown in FIG. 2, only half a period of Sin AC (alternating current) can be effective working-time when AC is used as its operational power supply, while each LED will not emit light in the other half period, such that the luminous efficiency thereof is not high. Moreover, referring to FIG. 3, a noise current will be resulted from the inherent characteristic of LEDs, and the noise current will generate an adverse effect to the quality of the whole AC power supply.

SUMMARY OF THE INVENTION

Aiming at the disadvantage above mentioned, the question that the reliability of the conventional decorative light string which is simply connected in series is rather poor and its life-span is shorter, and the question that the cost of existing decorative light string which is simply connected in parallel is rather high, both will be solved.

To resolve the technical problem mentioned above, The present invention provides a LED decorative light string that comprises one or more branch circuits, each of said more branch circuits is connected each other in parallel, and then connected to a common power supply wire for importing operational voltage; each said branch circuit comprises a quantity of light groups, and said light groups are serially connected in turn; each said light group comprises two or more LEDs, wherein at least one LED is connected in parallel with other LEDs in reverse direction, said other LEDs are connected in parallel in the same direction.

In the present invention, each branch circuit can be arranged in turn along the same direction; each light group is arranged in turn along the same direction within the same branch circuit; each LED is arranged in turn along the same direction within the same light group, thus making the effect that each LED is connected in turn on the external structure.

In each light group of the present invention, preferably two LEDs are utilized, and said two LEDs are connected in parallel in reverse direction. In particular, two LED chips can be adopted and integrated into a same housing.

After adopting the technical solution of the present invention, each LED is connected one by one in turn from the external structure of view that is similar to the external structure of a conventional LED decorative light string. Each light group has two or more LEDs and at least one LED is connected in parallel with other LEDs in reverse from the circuit connection structure of view, thus current can flow though the LED which are connected in parallel in the same direction or reverse with certain LED when the certain LED is failure, thereby the whole LED decorative light string would not be invalidated; Moreover, the total operational voltage of the suitable quantity of light groups that are connected in series is just equal to AC voltage in commercial power because each light group is connected in series, such that a step-down transformer is not required. It is obvious that the LED decorative light string of the present invention have the advantage of more economical, more reliable in performance, more long life-span when compared with a conventional LED decorative light string.

BRIEF DESCRIPTION OF THE DRAWINGS

The present invention will be further explained from combining with the accompanying drawings and embodiments hereinafter, in the accompanying drawings.

DETAILED DESCRIPTION OF THE PERFERRED EMBODIMENT

Figure 5:
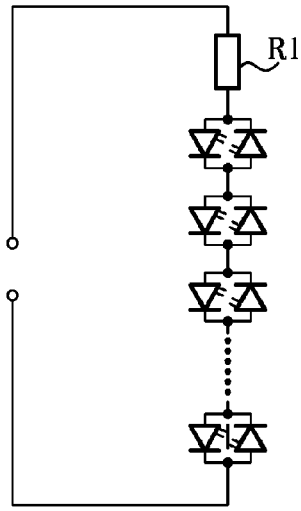
FIG. 5 is a schematic view of the circuit connecting relation of a LED decorative light string in accordance with a preferred embodiment of the present invention.

In a preferred embodiment of the present invention, the circuit connecting relation of a LED decorative light string is shown in FIG. 5. It can be seen from the figure that there comprise a quantity of light groups and the light groups are in turn connected in series; in each light group, there are two LEDs connected in parallel in reverse direction in the circuit.

The total operational voltage of the suitable quantity of light groups that are connected in series is just equal to AC voltage in commercial power because each light group is connected in series, such that a step-down transformer is not required. For example, in respect to 220V AC power supply, 73 light groups can be in turn connected in series if the operational voltage of the LED is 3V. On the other hand, because two LEDs in each light group are connected in parallel in reverse direction, thereby only the other LEDs which are connected in the same direction could not normally working when one LED is failure, but the LEDs which are connected in reverse direction could still normally working. Upon the case that more than 70 light groups are connected in series, the chance that two LEDs in the same light group are failure at one time is very small according to statistical probability. Therefore, such LED decorative light string has the advantages of more economical, more reliable in performance, more long in life span and so on.

Figure 4:
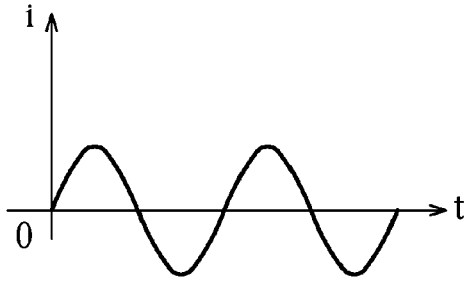
FIG. 4 is a schematic view of the current waveforms of the operating decorative light string shown in FIG. 5.

On the other hand, because two LEDs in each light group are connected in parallel in reverse direction, when AC power supply is directly connected to the light string, the positive half-period of Sin AC will make all LEDs lighting that are connected in forward direction thereof and the negative half-period of Sin AC will make all LEDs lighting that are connected in reverse direction thereof, i.e. there are LEDs working normally in both the positive and the negative half-period of Sin AC. The current waveform in working are shown in FIG. 4, in contrast, the decorative light string of the present embodiment have higher luminous efficiency, and noise current caused from only using half a period may not occur.

Figure 1:
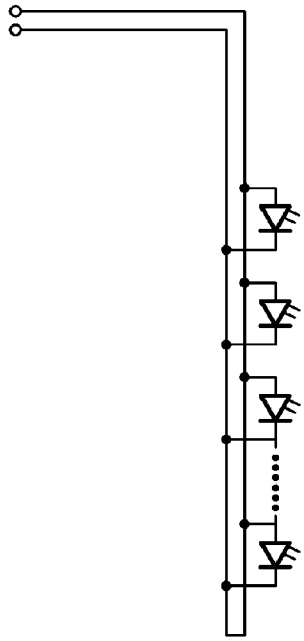
FIG. 1 is a schematic view of the circuit connecting relation of a LED decorative light string in the prior art.
Figure 2:
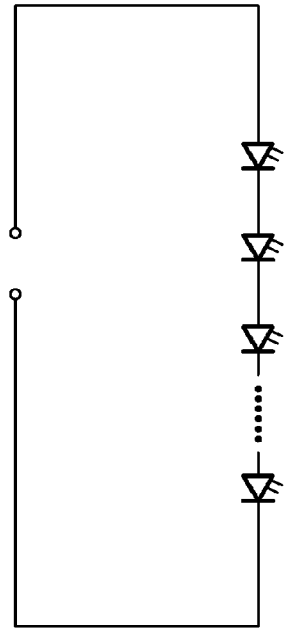
FIG. 2 is a schematic view of the circuit connecting relation of another LED decorative light string in the prior art.
Figure 3:
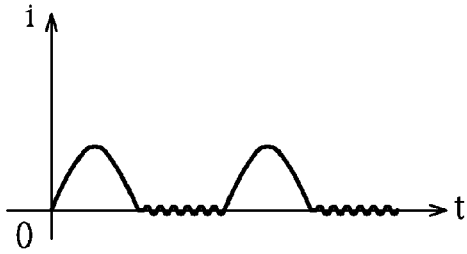
FIG. 3 is a schematic view of the current waveforms of the operating decorative light string shown in FIG. 2.

Moreover, because two LEDs in each light group are connected in parallel in reverse direction, when there is static electricity in any one of directions, the instantaneous high voltage of said static electricity can be released through each LEDs in the same direction, and the LEDs could not be broken. In contrast, there is static electricity in the opposite direction in the circuit shown in FIG. 1 and FIG. 2, the instantaneous high voltage would breakdown certain LED, thus a diode utilized to prevent static electricity is needed to serially connected in reverse direction to the leading of the power supply. But in the present embodiment, such diode for preventing static electricity is not required and the object of preventing static electricity can be achieved.

It can be seen from FIG. 5 that there is a current limiting resistance R1 connected for avoiding the current over high. Of course, other current limiting circuit can also be adopted.

Figure 7:
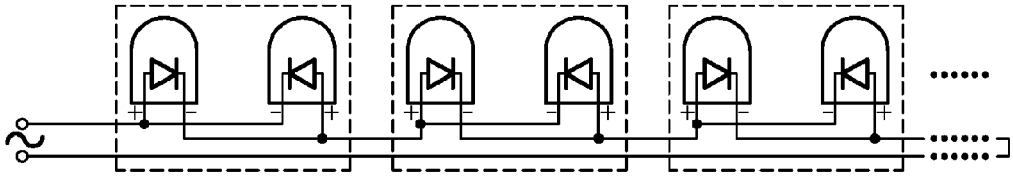
FIG. 7 is a schematic view of the connection configuration of the LED decorative light string shown in FIG. 5.
Figure 8:
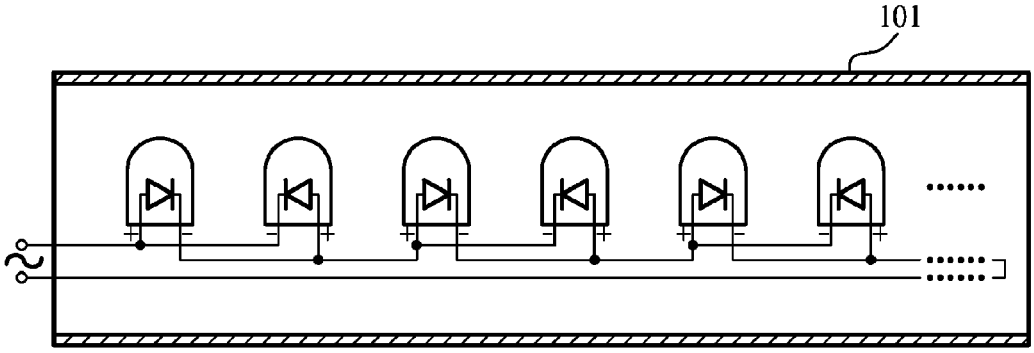
FIG. 8 is a schematic view showing that the LED decorative light string shown in FIG. 7 is mounted into a photic pipe.

Referring to FIG. 7, there is shown the external connecting structure of the LED decorative light string shown in FIG. 5. It can be seen from the figure that the first and the second LED are connected in parallel in reverse direction to form one light group; the third and the fourth LED are connected in parallel in reverse direction to form another light group; the fifth and the sixth LED are connected in parallel in reverse direction to form further one light group, and the like, the light groups are connected in turn in series. Seeing from the whole external shape, each LED is arranged in turn along the conducting wire, similarly to a conventional LED decorative light string but there are more connecting wires. Moreover, the LEDs which are connected in turn and its connecting wires shown in FIG. 7 can also be installed into a transparent pipe 101, such as a transparent plastic pipe, thus a variety of shapes can be achieved by bending or knitting according to a demand.

Figure 6:
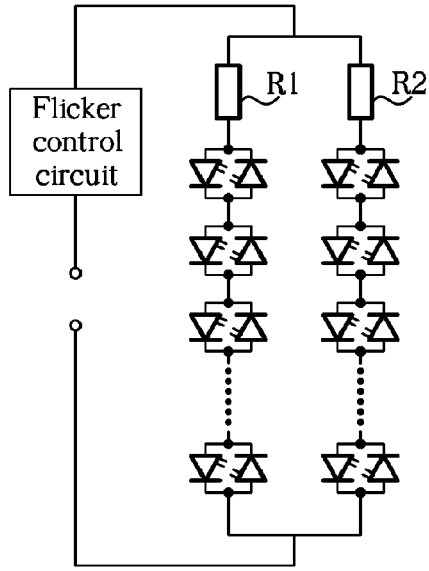
FIG. 6 is a schematic view of the circuit connecting relation of a LED decorative light string in accordance with another preferred embodiment of the present invention.
Figure 9:
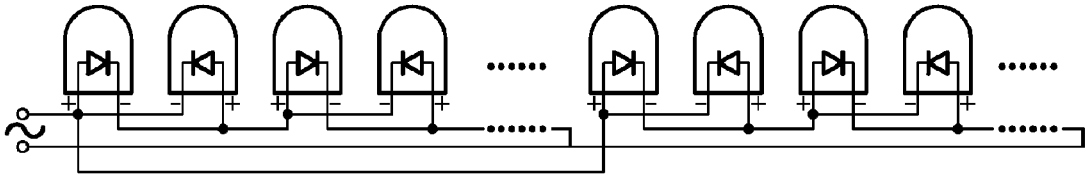
FIG. 9 is a schematic view of the connection configuration of the LED decorative light string shown in FIG. 6.

In another preferred embodiment of the present invention, the connecting relation of the circuit of the LED decorative light string is shown in FIG. 6 which differs from FIG. 5 in adding one branch circuit and a flicker control circuit and the other connecting relation is similar to that in FIG. 5. The circuit technologies about controlling flicker of the decorative light are known in the prior art. For example, a oscillating circuit may be utilized to generating a control signal, and then the base of a triode is controlled with the control signal, while the emitter and the collector of the triode are serially connected to the power supply wire of the LED decorative light string. At the time, the connecting structure shown in FIG. 9 can be adopted to arrange two branch circuits along the same direction for ensuring that the external structure of each LED is still connected in turn.

Figure 12:
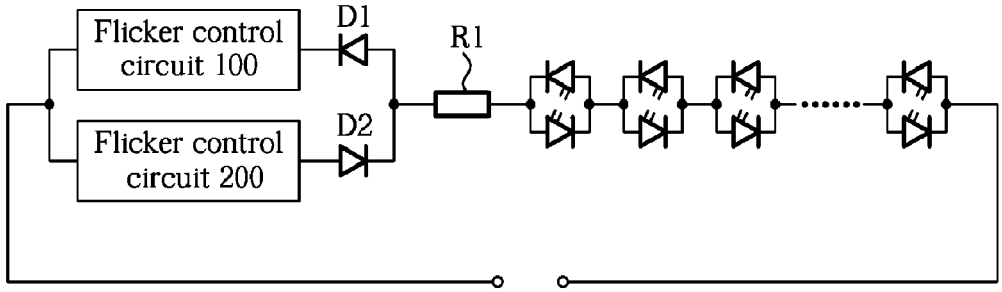
FIG. 12 is a schematic view of the circuit connecting relation of a LED decorative light string in accordance with another preferred embodiment of the present invention.

The circuit shown in FIG. 12 can be adopted to control the LEDs which are connected in positive direction and in reverse direction respectively. Referring to FIG. 12, the flicker control circuit 100 which is provide at top part controls those LEDs which are provide at top part via a rectifier diode D1, and the flicker control circuit 200 which is provide at lower part controls those LEDs which are provide at lower part via a rectifier diode D2.

Figure 11:
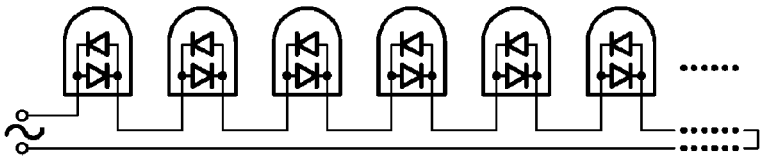
FIG. 11 is a schematic view of the connecting relation of a decorative light string in accordance with another preferred embodiment of the present invention.

In the case that there are two LEDs within one light group, two LED chips can be adopted, connected in parallel in reverse direction and integrated into a same housing as shown in FIG. 11. In this case, the connection thereof is very convenient and the connection wire can be saved. Furthermore, in the case that there are two LEDs within one light group, the LEDs having two kinds of colors can be adopted. Two colors of light can be emitted when the two LEDs emit light individually and respectively; moreover, another one or more colors of light can be achieved through adjusting the overlap time, the sequence of the two LEDs which emit light at the same time.

Figure 10:
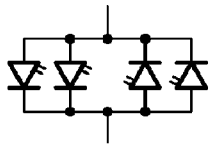
FIG. 10 is a schematic view of the connecting relation when four LEDs are utilized in one light group in accordance with another preferred embodiment of the present invention.

In other embodiments, each light group may have more LEDs connected, preferably even numbers of LEDs connected. The light group has 4 LEDs as shown in FIG. 10 wherein 2 LEDs in the left are connected in parallel in the same direction and 2 LEDs in the right are also connected in parallel in the same direction, but 2 left LEDs are connected in parallel with 2 right LEDs in reverse direction. So when certain a LED is failure, because the other LED in the same group is connected in parallel with it in the same direction, such that other LEDs will not be affected and will be normally working. Furthermore, the number of light groups in each branch circuit can be adjusted according to practical requires, and more branch circuits can be utilized.

What is claimed is:

1. A LED decorative light string, comprising:

one or more branch circuits, each said branch circuits being connected in parallel then connected to a common power supply wire for importing operational voltage;

said branch circuit comprising a quantity of light groups that are connected in series; said light group comprising two or more LEDs, at least one of said LEDs being connected in parallel with other said LEDs in reverse direction, other said LEDs being connected in parallel in the same direction;

two flicker control circuits being connected with said power supply wire:

one end of the first flicker control circuit being connected with said power supply wire, and the other end of the first flicker control circuit being connected with said one or more branch circuits via a positive direction diode, one end of the second flicker control circuit being connected with said power supply wire, the other end of the second flicker control circuit is connected with said one or more branch circuits via a reverse direction diode.

2. The LED decorative light string according to claim 1, wherein a current limiting resistor is serially connected in said branch circuit for limiting current.

3. The LED decorative light string according to claim 1, wherein each said light group comprises even numbers of said LEDs, half of said LEDs are connected in parallel, and the other half are connected in parallel in reverse direction.

4. The LED decorative light string according to claim 3, wherein each said branch circuit comprises 10 to 100 said light groups connected in series and comprises two said LEDs, connected in parallel in reverse direction.

5. The LED decorative light string according to claim 3, wherein two said LEDs in said light group are two light emitting diode chips integrated into a same housing.

6. The LED decorative light string according to claim 3, wherein two said LEDs in said light groups are two LEDs having two kinds of color.

7. The LED decorative light string according to claim 4, wherein two said light emitting diode chips have two different colors.

8. The LED decorative light string according to claim 1, wherein said branch circuit is arranged one by one along a same direction; said light group is arranged one by one along the same direction within said branch circuit; said LED is arranged one by one along the same direction within said light group, thereby, the connection of said LEDs appears one by one continually.

9. The LED decorative light string according to claim 8, wherein said LEDs and connecting wires thereof are installed into a transparent pipe.

* * * * *